US006497344B1

(12) United States Patent
Dial

(10) Patent No.: US 6,497,344 B1
(45) Date of Patent: Dec. 24, 2002

(54) MULTIPLE BEVERAGE PITCHER DEVICE

(76) Inventor: Elston Dial, 5267 Paramount Dr., Irondale, AL (US) 35210

( * ) Notice: Subject to any disclaimer, the term of this patent is extended or adjusted under 35 U.S.C. 154(b) by 0 days.

(21) Appl. No.: 09/910,267

(22) Filed: Jul. 20, 2001

(51) Int. Cl.[7] ..... B67D 5/06
(52) U.S. Cl. ..... 222/144.5; 222/465.1
(58) Field of Search ..... 222/129, 142.7, 222/142.9, 144.5, 465.1, 548

(56) References Cited

U.S. PATENT DOCUMENTS

| | | | | |
|---|---|---|---|---|
| 3,705,661 A | | 12/1972 | Davis | |
| 3,831,743 A | | 8/1974 | Leedy | |
| 3,876,112 A | | 4/1975 | Kramer | |
| 4,301,942 A | | 11/1981 | Kupperman et al. | |
| D279,621 S | | 7/1985 | Richer | |
| 4,705,192 A | * | 11/1987 | Knapton | 222/144.5 |
| 5,588,550 A | * | 12/1996 | Meyer | 222/144.5 |
| 5,758,786 A | * | 6/1998 | John | 222/142.9 |
| 5,794,819 A | | 8/1998 | Smith | |
| 5,890,627 A | * | 4/1999 | Storey | 222/142.9 |
| 5,921,440 A | | 7/1999 | Maines | |
| 6,302,301 B1 | * | 10/2001 | Vette | 222/142.9 |

FOREIGN PATENT DOCUMENTS

| | | | | |
|---|---|---|---|---|
| FR | 2699143 | * | 6/1994 | 222/144.5 |

* cited by examiner

*Primary Examiner*—Joseph A. Kaufman

(57) ABSTRACT

A multiple beverage pitcher device for effecting storing four different types of chilled beverages in one pitcher for up to two hours. The multiple beverage pitcher device includes a container having insulation-filled bottom and side walls, an open top, and a plurality of beverage-holding chambers being disposed therein; and also includes a lid being rotatably and sealingly disposed upon the container; and further includes a handle being securely attached to an exterior of the side wall of the container; and also includes a seal being attached to the lid for sealing the lid upon the container.

1 Claim, 3 Drawing Sheets

MULTIPLE BEVERAGE PITCHER DEVICE

BACKGROUND OF THE INVENTION

1. Field of the Invention

The present invention relates to a multiple beverage container and more particularly pertains to a new multiple beverage pitcher device for effecting storing four different types of chilled beverages in one pitcher for up to two hours.

2. Description of the Prior Art

The use of a multiple beverage container is known in the prior art. More specifically, a multiple beverage container heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,705,661; U.S. Pat. No. 3,876,112; U.S. Pat. No. 3,831,743; U.S. Pat. No. 4,301,942; U.S. Pat. No. 5,794,819; U.S. Pat. No. 5,921,440; and U.S. Pat. No. Des. 279,621.

While these devices fulfill their respective, particular objectives and requirements, the aforementioned patents do not disclose a new multiple beverage pitcher device. The inventive device includes a container having insulation-filled bottom and side walls, an open top, and a plurality of beverage-holding chambers being disposed therein; and also includes a lid being rotatably and sealingly disposed upon the container; and further includes a handle being securely attached to an exterior of the side wall of the container; and also includes a seal being attached to the lid for sealing the lid upon the container.

In these respects, the multiple beverage pitcher device according to the present invention substantially departs from the conventional concepts and designs of the prior art, and in so doing provides an apparatus primarily developed for the purpose of effecting storing four different types of beverages in one pitcher.

SUMMARY OF THE INVENTION

In view of the foregoing disadvantages inherent in the known types of multiple beverage container now present in the prior art, the present invention provides a new multiple beverage pitcher device construction wherein the same can be utilized for effecting storing four different types of beverages in one pitcher.

The general purpose of the present invention, which will be described subsequently in greater detail, is to provide a new multiple beverage pitcher device which has many of the advantages of the multiple beverage container mentioned heretofore and many novel features that result in a new multiple beverage pitcher device which is not anticipated, rendered obvious, suggested, or even implied by any of the prior art multiple beverage container, either alone or in any combination thereof.

To attain this, the present invention generally comprises a container having insulation-filled bottom and side walls, an open top, and a plurality of beverage-holding chambers being disposed therein; and also includes a lid being rotatably and sealingly disposed upon the container; and further includes a handle being securely attached to an exterior of the side wall of the container; and also includes a seal being attached to the lid for sealing the lid upon the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multiple beverage pitcher device which has many of the advantages of the multiple beverage container mentioned heretofore and many novel features that result in a new multiple beverage pitcher device which is not anticipated, rendered obvious, suggested, or even implied by any of the prior art multiple beverage container, either alone or in any combination thereof.

It is another object of the present invention to provide a new multiple beverage pitcher device which may be easily and efficiently manufactured and marketed.

It is a further object of the present invention to provide a new multiple beverage pitcher device which is of a durable and reliable construction.

An even further object of the present invention is to provide a new multiple beverage pitcher device which is susceptible of a low cost of manufacture with regard to both materials and labor, and which accordingly is then susceptible of low prices of sale to the consuming public, thereby making such multiple beverage pitcher device economically available to the buying public.

Still yet another object of the present invention is to provide a new multiple beverage pitcher device which provides in the apparatuses and methods of the prior art some of the advantages thereof, while simultaneously overcoming some of the disadvantages normally associated therewith.

Still another object of the present invention is to provide a new multiple beverage pitcher device for effecting storing four different types of beverages in one pitcher.

Yet another object of the present invention is to provide a new multiple beverage pitcher device which includes a container having insulation-filled bottom and side walls, an open top, and a plurality of beverage-holding chambers being disposed therein; and also includes a lid being rotatably and sealingly disposed upon the container; and further includes a handle being securely attached to an exterior of the side wall of the container; and also includes a seal being attached to the lid for sealing the lid upon the container.

Still yet another object of the present invention is to provide a new multiple beverage pitcher device that is easy and convenient to use.

Even still another object of the present invention is to provide a new multiple beverage pitcher device that saves the user time by being able to serve multiple beverages from one container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
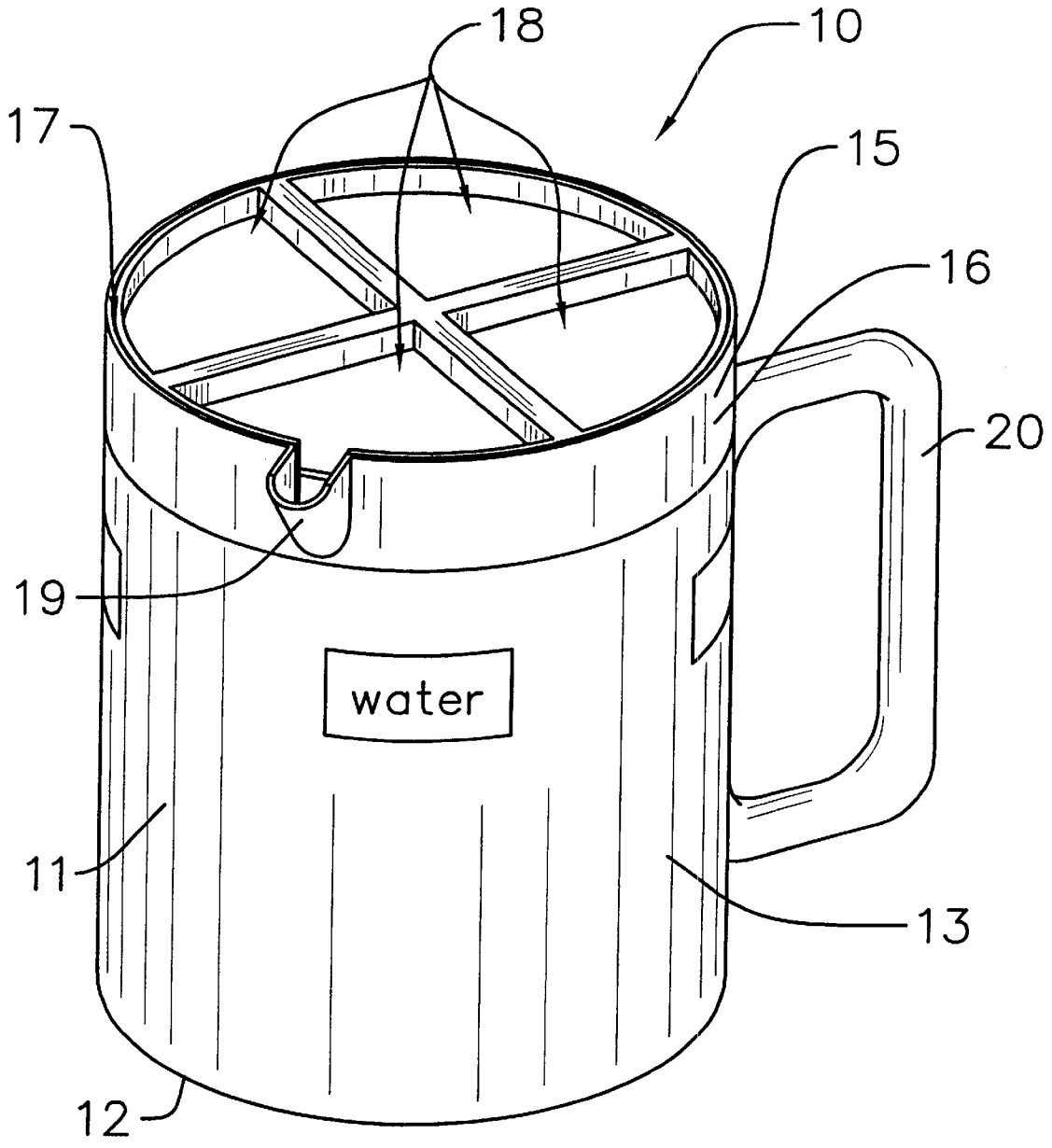
FIG. 1 is a perspective view of a new multiple beverage pitcher device according to the present invention.
Figure 2:
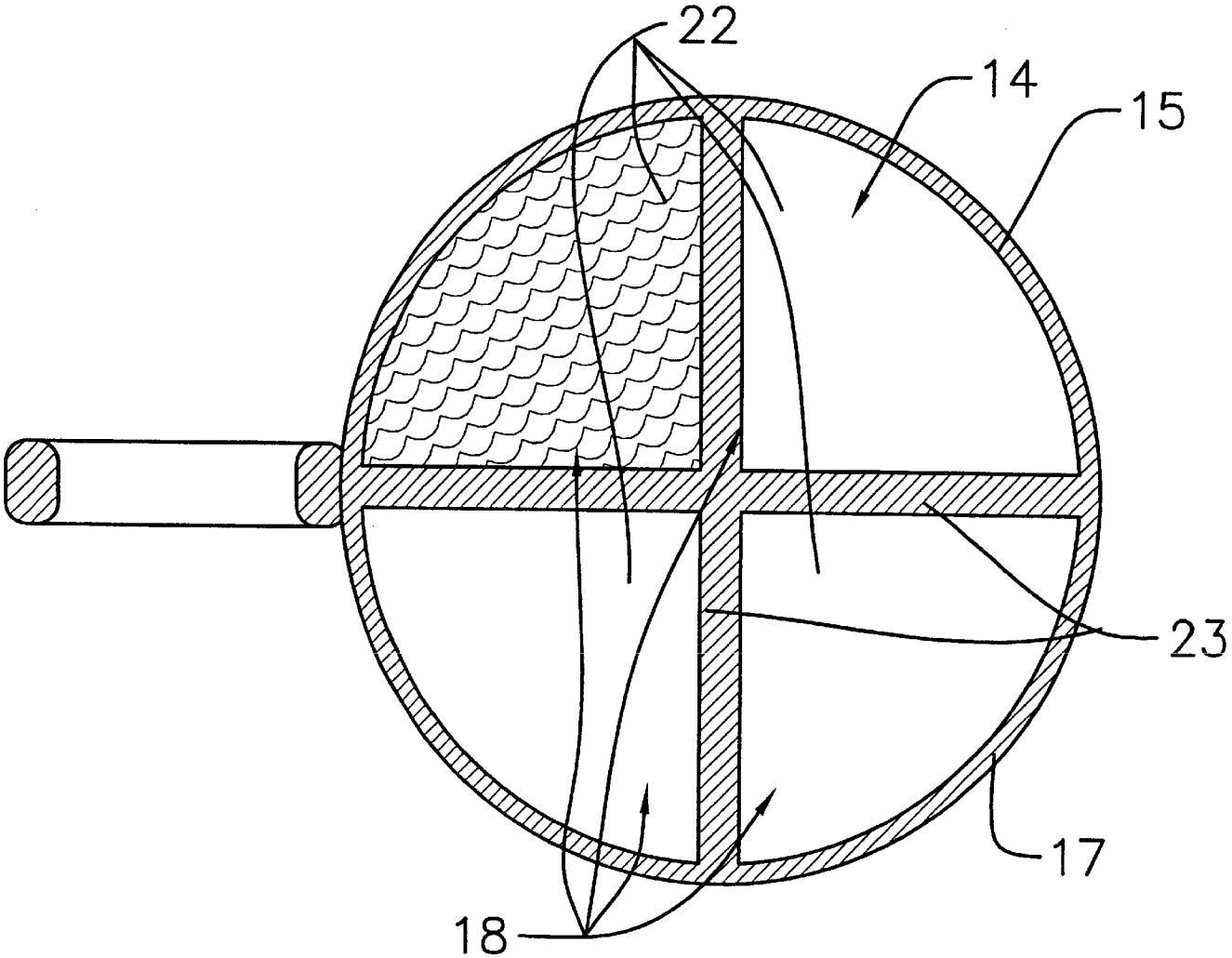
FIG. 2 is a top plan view of the present invention.
Figure 3:
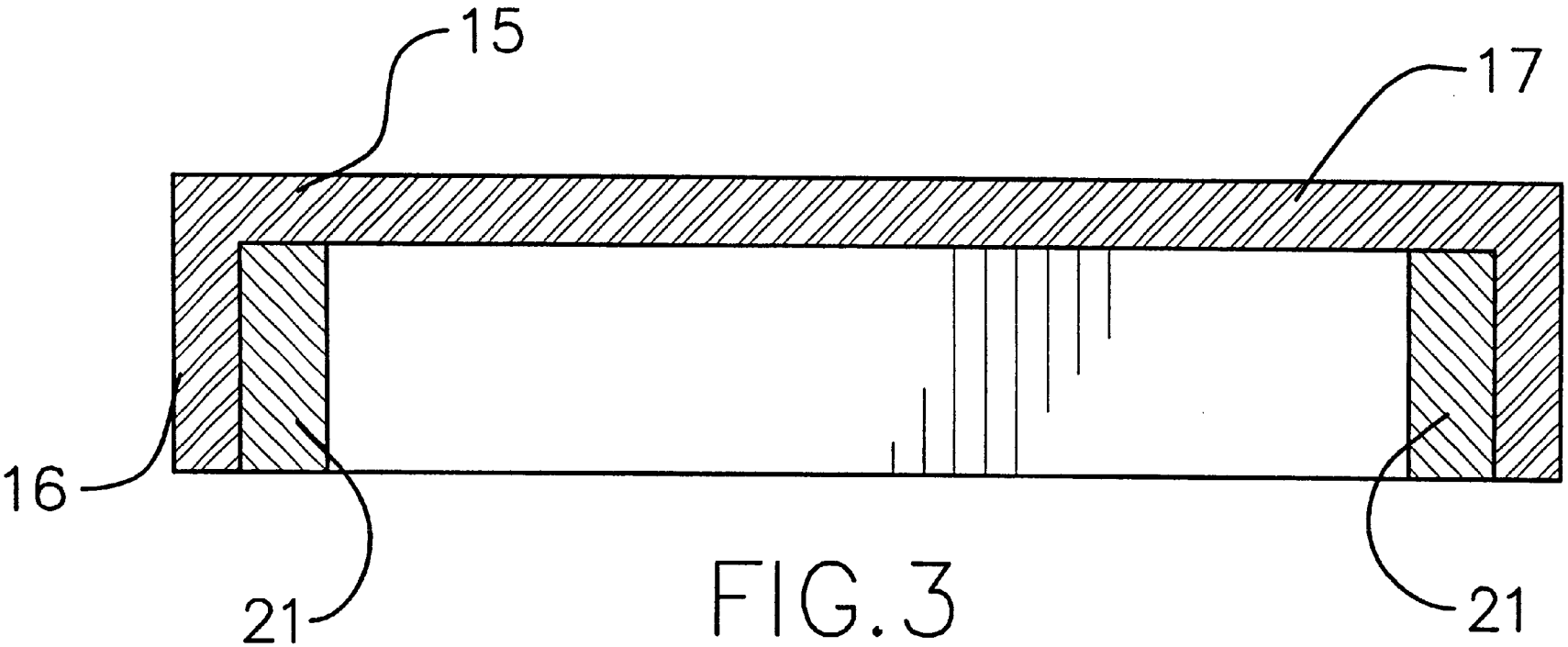
FIG. 3 is a cross-sectional view of the lid of the present invention.

With reference now to the drawings, and in particular to FIGS. 1 through 3 thereof, a new multiple beverage pitcher device embodying the principles and concepts of the present invention and generally designated by the reference numeral 10 will be described.

As best illustrated in FIGS. 1 through 3, the multiple beverage pitcher device 10 generally comprises a container 11 having insulation-filled bottom and side walls 12, 13, an open top 14, and a plurality of beverage-holding chambers 22 being disposed therein. The beverage-holding chambers 22 include a plurality of partitions 23 being securely and conventionally disposed in the container 11 and separating the beverage-holding chambers 22. The partitions 23 crisscross in the container 11 with the beverage-holding chambers 22 being generally of equal size. Each of the partitions 23 has a height generally equal to that of the side wall 13 of the container 11. The container 11 has a height of approximately 18 inches and a diameter of approximately 8 inches and being adapted to hold approximately 64 fluid ounces of beverages.

A lid 15 is rotatably and sealingly disposed upon the container 11. The lid includes top and side walls 16, 17 and a plurality of openings 18 being disposed through the top wall 17. The lid 15 further includes a spout 19 being conventionally disposed in the side wall 16 and being adapted to dispense beverages therethrough from the container 11. A handle 20 is securely and conventionally attached to an exterior of the side wall 13 of the container 11. A seal 21 is conventionally attached to the lid 15 for sealing the lid 15 upon the container 11. The seal 21 is a ring gasket being securely and conventionally attached to an inner side of the side wall 16 of the lid 15.

In use, the user pours whatever beverages he/she wants in the beverage-holding chambers 22, and places the lid 15 upon the container 11, and rotates the lid 15 so that the spout 19 is disposed adjacent to the beverage-holding chamber 22 the user wishes to pour the beverage from. The user can rotate the lid 15 to any of the desired beverage-holding chambers 22 as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multiple beverage pitcher device comprising:

a container having insulation-filled bottom and side walls, an open top, and a plurality of beverage-holding chambers disposed therein;

a lid being rotatably and sealingly disposed upon said container;

a handle being securely attached to an exterior of said side wall of said container independent and separate of said lid such that said handle is immovable with respect to said container;

wherein said lid includes top and side walls, said side wall of said lid being rotatable with respect to the open top of said container, a spout being disposed in said side wall of said lid and being adapted to dispense beverages therethrough from said container;

wherein a plurality of partitions are disposed in said container to define and separate said beverage-holding chambers;

wherein said partitions crisscross in said container with said beverage-holding chambers being generally of equal size, each of said partitions having a height generally equal to that of said side wall of said container;

wherein four beverage holding chambers are disposed in said container;

wherein one of said partitions extends away from said handle in a substantially coplanar relationship with said handle, and another one of said partitions is located in a plane oriented substantially perpendicular to the plane of said handle; and a seal attached to said lid for sealing said lid upon said container, said seal comprising a ring gasket being securely attached to an inner side of a side wall of said lid.

* * * * *